US008166667B1

(12) United States Patent
Lora

(10) Patent No.: US 8,166,667 B1
(45) Date of Patent: May 1, 2012

(54) CLOTHES DRYING FURNITURE

(76) Inventor: Robert Lora, Hallandale Beach, FL (US)

( * ) Notice: Subject to any disclaimer, the term of this patent is extended or adjusted under 35 U.S.C. 154(b) by 941 days.

(21) Appl. No.: 12/168,337

(22) Filed: Jul. 7, 2008

(51) Int. Cl.
*F26B 19/00* (2006.01)
*F26B 25/06* (2006.01)

(52) U.S. Cl. ..... 34/202; 34/215; 34/239; 34/597

(58) Field of Classification Search ..... 34/202, 34/209, 215, 217, 239, 597
See application file for complete search history.

(56) References Cited

U.S. PATENT DOCUMENTS 2,061,499 A * 11/1936 Bode ..... 211/1.3
3,449,838 A * 6/1969 Chancellor, Jr. ..... 34/90
4,682,424 A * 7/1987 Irving ..... 34/202
5,305,484 A 4/1994 Fitzpatrick et al.
5,755,040 A 5/1998 Ou
5,815,961 A 10/1998 Estes et al.
5,870,836 A 2/1999 Grimes
6,067,723 A 5/2000 Lafrenz
6,238,031 B1 * 5/2001 Weng ..... 312/333
6,572,208 B2 6/2003 Albaizar et al.
6,910,292 B2 6/2005 Prows
6,922,913 B2 * 8/2005 Hood et al. ..... 34/597
6,928,752 B2 8/2005 Johnson et al.
6,973,740 B2 * 12/2005 Meyer ..... 34/202
7,861,436 B2 * 1/2011 Kim et al. ..... 34/202

* cited by examiner

*Primary Examiner* — Jiping Lu
(74) *Attorney, Agent, or Firm* — Albert Bordas, P.A.

(57) ABSTRACT

Clothes drying furniture, comprising a furniture assembly defining a housing. The furniture assembly has a first top wall, a first bottom wall, first and second lateral walls, an intermediate wall, a rear exterior wall, and a door. The first and second lateral walls each have longitudinal tracks mounted thereon. A clothes drying assembly comprises a second top wall, a second bottom wall, third and fourth lateral walls, and a rear wall. The third and fourth lateral walls each have longitudinal rails mounted thereon. The longitudinal rails are journally mounted onto the longitudinal tracks. An electrical assembly comprises a heating element. The heating element is positioned in between the intermediate wall and the rear exterior wall. The electrical assembly further comprises power means. The first and second lateral walls each comprise a latching member to keep the clothes drying assembly housed within the furniture assembly.

19 Claims, 4 Drawing Sheets

CLOTHES DRYING FURNITURE

BACKGROUND OF THE INVENTION

1. Field of the Invention

The present invention relates to furniture, and more particularly, to an article of furniture that dries clothing stored therein.

2. Description of the Related Art

Applicant believes that one of the closest references corresponds to U.S. Pat. No. 6,572,208, issued on Jun. 3, 2003 to Albaizar, et al. for Clothes Drying, Dewrinkling and Droning Cabinet. However, it differs from the present invention because Albaizar, et al. teach a clothes drying, dewrinkling and ironing cabinet comprising a main enclosure for housing clothes, access to said main enclosure being by way of a door, and means for drying and dewrinkling the clothes in said enclosure, said cabinet also having an ironing board unit. This ironing board unit is a folding one and is mounted on the inside of the door.

Applicant believes that another reference corresponds to U.S. Pat. No. 6,067,723 issued to Lafrenz on May 30, 2000 for Clothes Dryer Hanging Feature. However, it differs from the present invention because Lafrenz teaches a hanging feature for a clothes dryer. The hanging feature is included on the door, or on the cabinet adjacent the door opening so that shoes or other objects can be hung from the hanging feature and suspended in a position exposed to the hot air within the rotating drum while at the same time being held free from rotation with the rotating drum.

Applicant believes that another reference corresponds to U.S. Pat. No. 5,870,836 issued to Grimes on Feb. 16, 1999 for Portable Clothes Dryer. However, it differs from the present invention because Grimes teaches a portable clothes dryer that has a rectangular cabinet for storing a blower fan at a rear portion of the cabinet and shelf inserts at a front portion of the cabinet. The cabinet has vertical slots located on the inside of the cabinet side panels for receiving and storing the shelf inserts. The cabinet further has a pair of front door panels having aligned horizontal slots that extend along the inside of the front door and side panels. The shelf inserts are fitted into the horizontal slots and clothing is placed on the shelf inserts. The blower fan then circulates air about the clothing placed on the shelf inserts. After the clothes are dry, the shelf inserts are removed from the horizontal slots and placed in the vertical slots. The front door panels may then be closed and the portable clothes dryer can be conveniently stored. Rollers are provided on the bottom of the cabinet to aid in movement of the dryer.

Applicant believes that another reference corresponds to U.S. Pat. No. 5,815,961 issued to Estes, et al. on Oct. 6, 1998 for Clothes Treating Cabinet With Inflatable Hanger. However, it differs from the present invention because Estes, et al. teach a clothes treating apparatus and method for subjecting clothes items to moisture, pressure and heat for refreshing and dewrinkling the clothes items. A cabinet defines an interior region for receiving clothes, the interior region having opposed inner side surfaces. A door is hingedly connected to the cabinet for closing the interior region. An inflatable hanger for supporting shirt-like clothes items is disposed within the interior region. A blower selectively inflates the inflatable hanger for pressing the shirt-like clothes item against the cabinet inner side surfaces. A steam generation means is provided for introducing moist air into the cabinet for humidifying the clothes item disposed therein. A heater and fan supply heated air into the interior region for drying the shirt-like clothes items disposed therein. During the dewrinkling cycle, steam is introduced into the interior region while the inflatable hanger assembly is periodically inflated. Following the steaming period, the inflatable hanger is inflated while the clothes are subject to warm air such that the clothes wrinkles are pressed out and the clothes are partially dried, setting the clothes in a smooth appearance. Heated air is then delivered into the interior region to completely dry the clothes item.

Applicant believes that another reference corresponds to U.S. Pat. No. 5,755,040 issued to Ou on May 26, 1998 for Household Drying Center. However, it differs from the present invention because Ou teaches a multipurpose dryer which can serve as a household drying center to provide versatile drying function for a wide variety of clothing, fabric articles and other household goods. A cabinet has a heating chamber located at the bottom of the cabinet for generating forced and heated air as drying medium. There is a heated air chamber to receive and distribute heated air to a drying chamber located below the top wall of the cabinet and above the heated air chamber. There are hollow air ducts attached to the sidewalls of the cabinet and a perforate heat diffusion plate above the heated air chamber for evenly distributing heated air into the drying chamber. A versatile support means is disposed in the drying chamber for hanging clothes, draping large size or bulky goods, or supporting a wire basket for holding delicate drying goods. The clothes and goods are dried without tumbling, thus avoiding fraying or wrinkles.

Applicant believes that another reference corresponds to U.S. Pat. No. 5,305,484 issued to Fitzpatrick, et al. on Apr. 26, 1994 for Clothes Steaming and Drying Cabinet. However, it differs from the present invention because Fitzpatrick, et al. teach a clothes steaming and drying cabinet comprising a housing defining an interior region for the clothes. Hangers and a bar are provided for suspending jackets and trousers respectively. Weighted bars tension the clothes during steaming. A sub housing houses a heating element and a fan for delivering heated air into the interior region. A boiler tank generates steam for delivery into the region. During the steaming and drying cycle, steam is delivered for a steaming period of the cycle and subsequently heated air is delivered during the drying period of the cycle. During the steaming period, heated air is intermittently delivered into the interior region simultaneously with the steam to reduce the formation of condensation on the interior of the cabinet.

Applicant believes that another reference corresponds to U.S. Pat. No. 6,928,752 issued to Johnson, et al. on Aug. 16, 2005 for Combination Tumble and Cabinet Dryer. However, it differs from the present invention because Johnson, et al. teach a combination tumble and cabinet dryer appliance that includes a housing with a tumble dryer and a cabinet dryer therein. The tumble dryer and cabinet dryer are operable independently of one another. Separate sources of hot air are provided to each of the tumble and cabinet dryers. The cabinet dryer extends over and along one side of the tumble dryer. A portion of the cabinet dryer extends substantially along the height of the housing so as to receive long hanging clothes, such as a dress. Removable shelves are provided in the cabinet dryer for drying sweaters and the like.

Applicant believes that another reference corresponds to U.S. Pat. No. 6,910,292 issued to Prows on Jun. 28, 2005 for Clothes Drying Cabinet with Improved Air Distribution. However, it differs from the present invention because Prows teaches a clothes drying cabinet with an internal compartment for receiving clothes and having a plurality of air inlet nozzles. An air plenum provides air to the cabinet through the nozzles. The plenum has a decreasing cross section from one corner to an opposite corner to provide a balanced distribution of air through the nozzles at a substantially uniform velocity. The nozzles are angularly oriented to direct air across upper and lower surfaces of shelves mounted within the drying compartment.

Other patents describing the closest subject matter provide for a number of more or less complicated features that fail to solve the problem in an efficient and economical way. None of these patents suggest the novel features of the present invention.

SUMMARY OF THE INVENTION

The instant invention is clothes drying furniture, comprising a furniture assembly defining a housing. The furniture assembly has a first top wall, a first bottom wall, first and second lateral walls, an intermediate wall, a rear exterior wall, and a door. The first and second lateral walls each have longitudinal tracks mounted thereon. A clothes drying assembly comprises a second top wall, a second bottom wall, third and fourth lateral walls, and a rear wall. The third and fourth lateral walls each have longitudinal rails mounted thereon. The longitudinal rails are journally mounted onto the longitudinal tracks. An electrical assembly comprises a heating element. The heating element is positioned in between the intermediate wall and the rear exterior wall. The electrical assembly further comprises power means.

The first and second lateral walls each comprise a latching member to keep the clothes drying assembly housed within the furniture assembly. The longitudinal tracks respectively comprise first stoppers and the longitudinal rails respectively comprise second stoppers. The first stoppers block the second stoppers, thereby allowing the clothes drying assembly to protrude a first predetermined distance from the furniture assembly when the latching members are unlatched.

The clothes drying assembly further comprises at least one dividing wall positioned in between the third and fourth lateral walls. The clothes drying assembly further comprises at least one hook to hang at least one article of clothing therefrom. The electrical assembly further comprises at least one control panel, which comprises at least one switch, and the electrical assembly also comprises illuminating means.

The furniture assembly further comprises at least one internal sidewall positioned in between the first and second lateral walls, and at least one drawer that rests upon the first bottom wall. The drawer may comprise a handle. The furniture assembly further comprises at least one shelve that is positioned in between the intermediate wall and the door, and a basket to support a scented pad. The rear exterior wall is a second predetermined distance from the rear wall and the rear wall is a third predetermined distance from the intermediate wall, and in the preferred embodiment, the door has hinges, a door handle, and a mirror mounted thereon.

It is therefore one of the main objects of the present invention to provide clothes drying furniture that dries clothes stored therein.

It is another object of this invention to provide clothes drying furniture that is compact and versatile.

It is another object of this invention to provide clothes drying furniture that can be mounted in bathrooms, closets, or any surface area of a structure.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
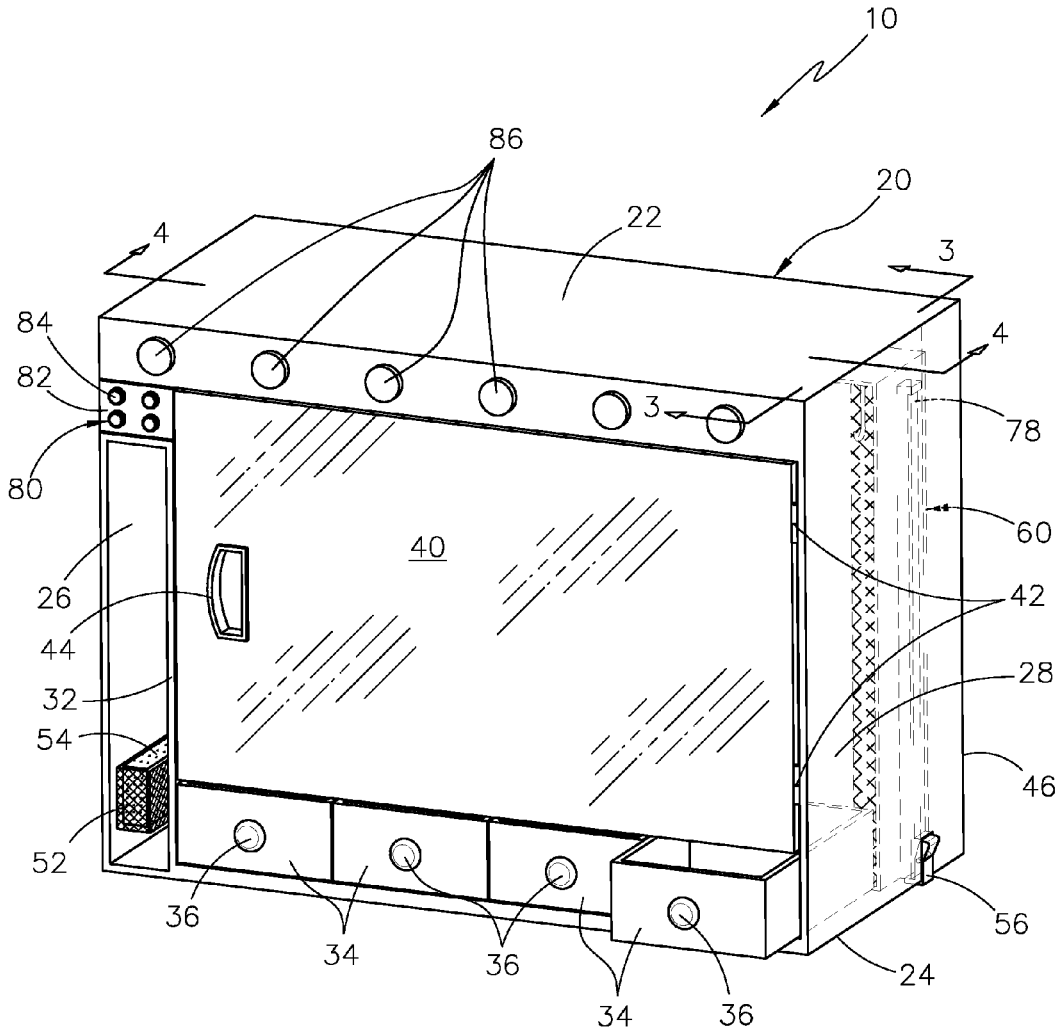
FIG. 1 represents an isometric view of the instant invention with the clothes drying assembly retracted.

Referring now to the drawings, the present invention is generally referred to with numeral 10. It can be observed that it basically includes furniture assembly 20, clothes drying assembly 60, and electrical assembly 80.

Figure 2:
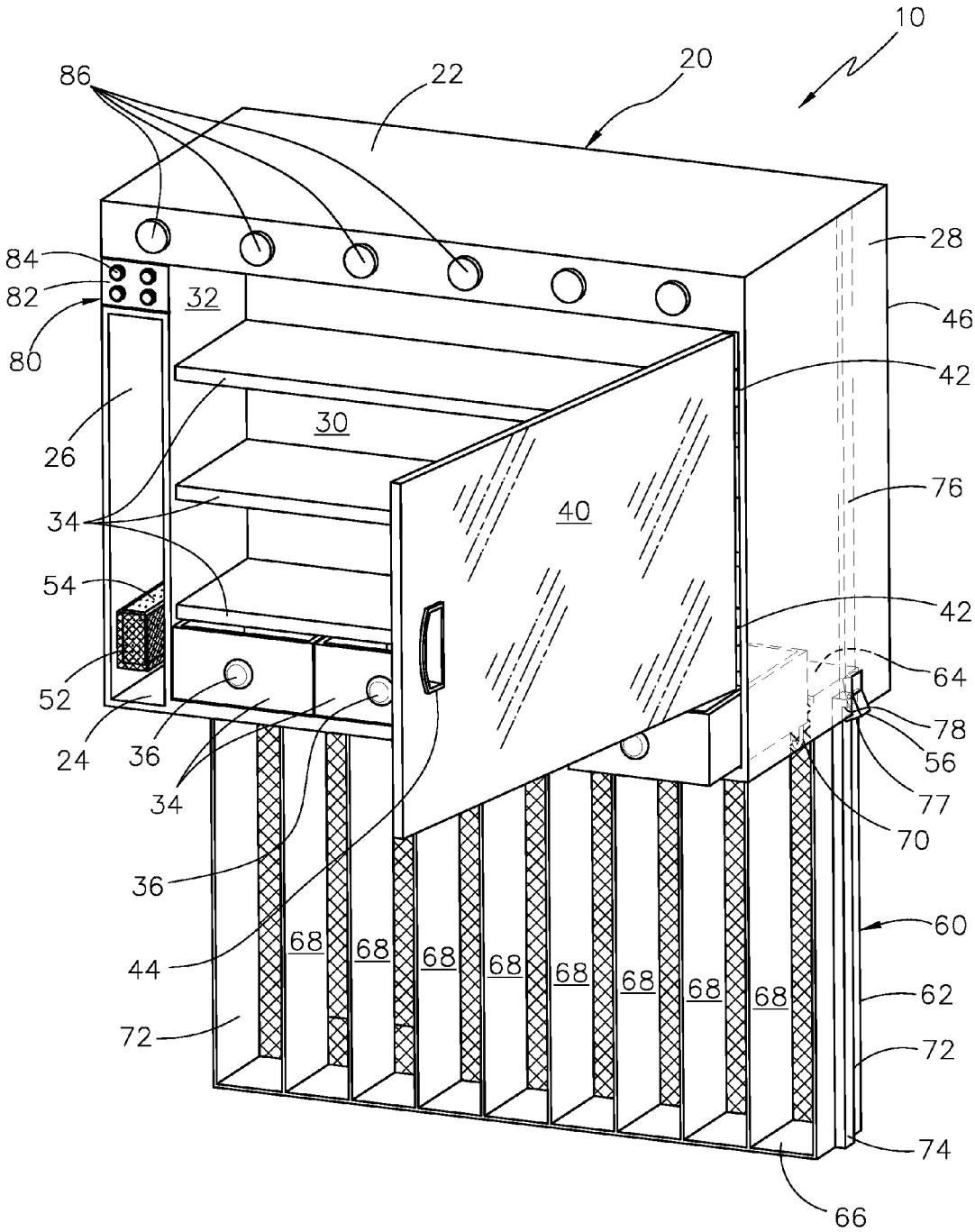
FIG. 2 represents an isometric view of the instant invention with the clothes drying assembly extracted and the door open.

As seen in FIGS. 1 and 2, furniture assembly 20 defines a housing, comprising top wall 22, bottom wall 24, lateral walls 26 and 28, intermediate wall 30, rear exterior wall 46, and mirror door 40. Lateral walls 26 and 28 each have longitudinal tracks 76 mounted thereon. Furniture assembly 20 further comprises internal sidewall 32 positioned in between lateral walls 26 and 28. As seen in this illustration, furniture assembly 20 further comprises drawers 34 that rest upon bottom wall 24. Each drawer 34 comprises a handle 36. Shelves 38 are positioned in between intermediate wall 30 and mirror door 40. Furniture assembly 20 further comprises basket 52 to support scented pad 54. Scented pad 54 comprises scents or aromas to aromatize the immediate area of instant invention 10, and articles of clothing, not seen, within instant invention 10. Mirror door 40 is suspended by hinges 42, and comprises door handle 44.

Clothes drying assembly 60 comprises top wall 64, bottom wall 66, lateral walls 72, and rear wall 62. Lateral walls 72 each having longitudinal rails 74 mounted thereon. Longitudinal rails 74 are journally mounted onto longitudinal tracks 76. Clothes drying assembly 60 further comprises dividing wall 68 positioned in between lateral walls 72. Clothes drying assembly 60 further comprises hooks 70 to hang articles of clothing therefrom. Lateral walls 26 and 28 each comprise a latching member 56 to keep clothes drying assembly 60 housed within furniture assembly 20 in a retracted position as seen in FIG. 1.

To extract clothes drying assembly 60 from furniture assembly 20, each latching member 56 is actuated, thereby allowing drying assembly 60 to extract from furniture assembly 20 by gravity as seen in FIG. 2. It is noted that longitudinal rails 74 are journally mounted onto longitudinal tracks 76 and are biased to each other with a sufficient force to control the velocity of drying assembly 60 when extracting from furniture assembly 20. In an alternate embodiment, furniture assembly 20 does not comprise latching members 56. Instead, furniture assembly 20 further comprises a motor assembly, not shown, that automatically extracts and retracts drying assembly 60 from furniture assembly 20 when a switch 84 is pressed, seen in FIG. 1. It is noted that longitudinal rails 74 are journally mounted onto longitudinal tracks 76 and are biased to each other with a sufficient force to control the velocity of drying assembly 60 when extracting from furniture assembly 20.

Figure 3:
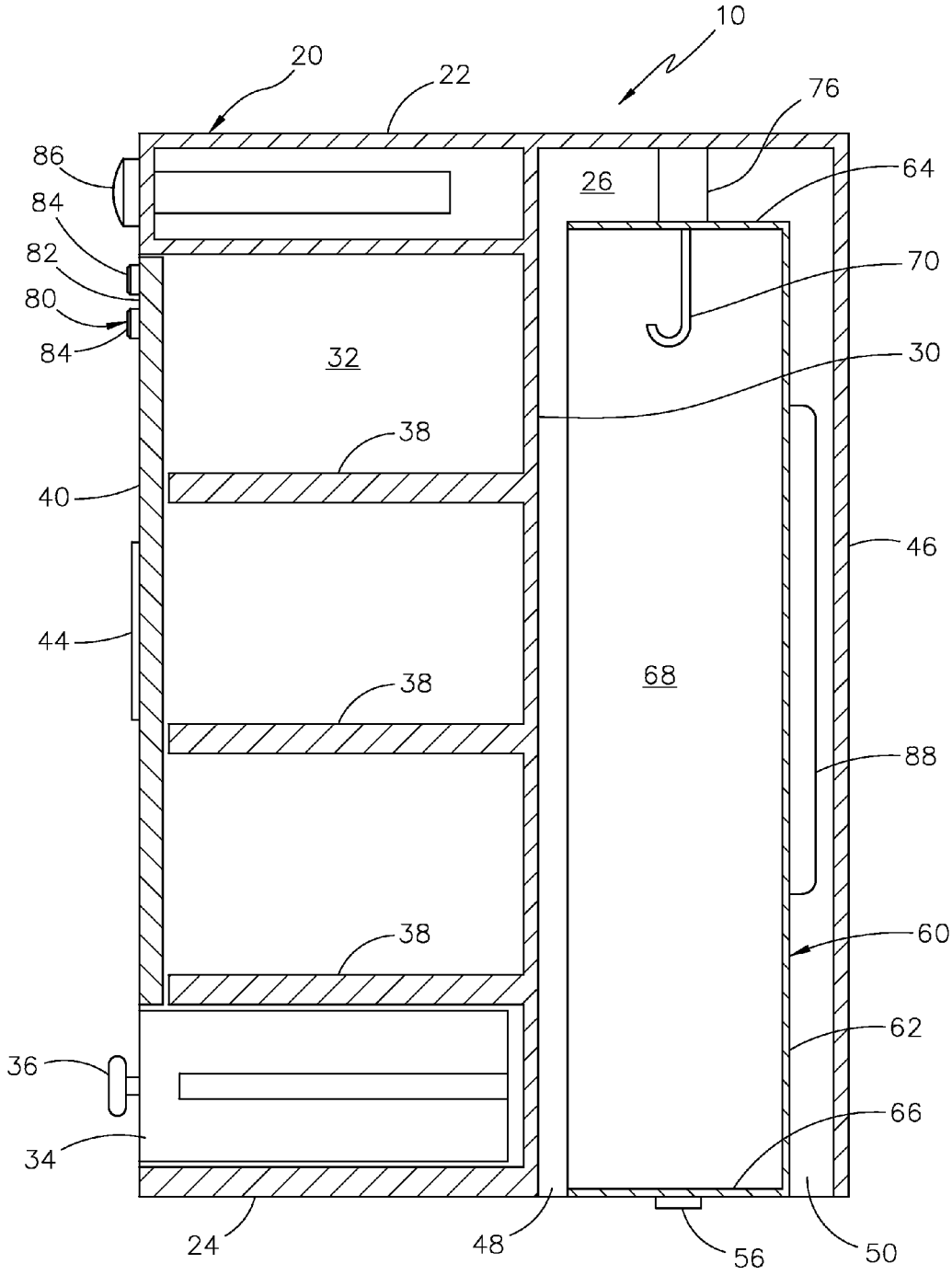
FIG. 3 is a cross section view of the instant invention taken along lines 3-3 as seen in FIG. 1.
Figure 4:
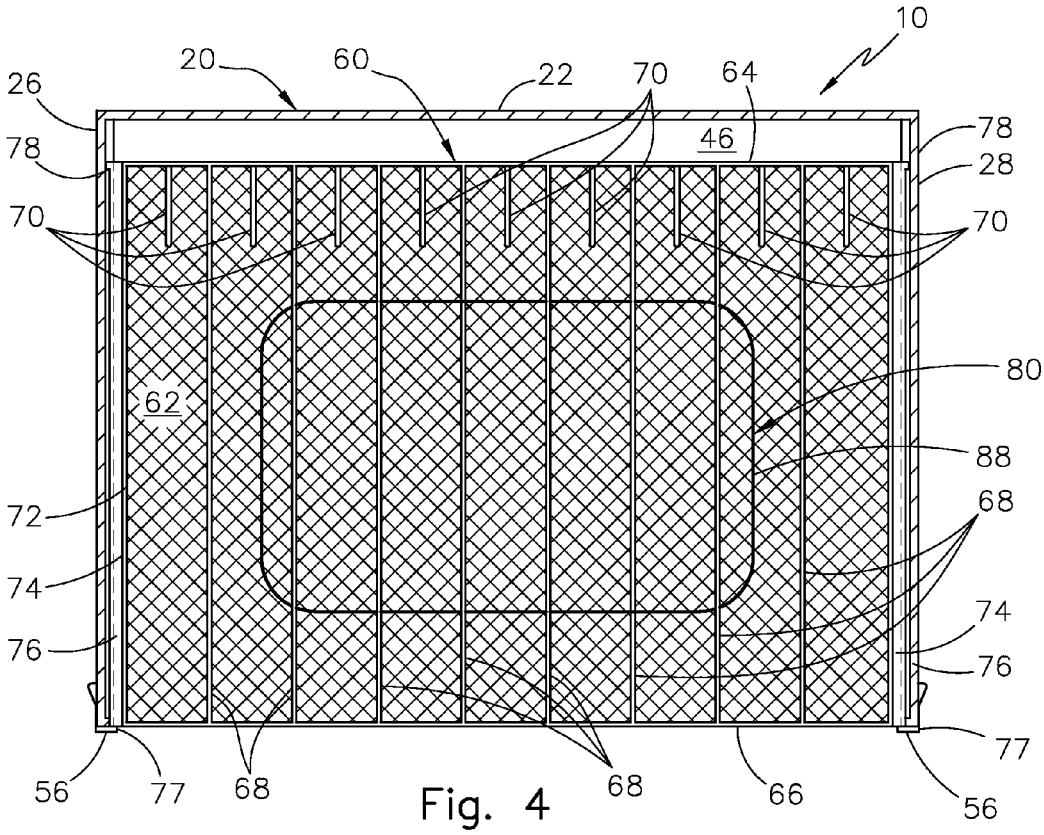
FIG. 4 is a cross section view of the instant invention taken along lines 4-4 as seen in FIG. 1.

As best seen in FIGS. 3 and 4, electrical assembly 80 comprises heating and drying element 88. Heating and drying element 88 is positioned in between intermediate wall 30 and rear exterior wall 46. Rear exterior wall 46 is a predetermined distance from rear wall 62, defining gap 50, and rear wall 62 is a another predetermined distance from intermediate wall 30 defining gap 48. In the preferred embodiment, rear wall 62 is made out of a netting material or mesh to allow heat produced by heating and drying element 88 to dry the articles of clothing, not seen, within clothes drying assembly 60.

Although not illustrated, it is noted that electrical assembly 80 further comprising power means to power instant invention 10. Such power means can comprise a power cord that plugs into an electrical outlet or a battery source. As seen in FIG. 1, electrical assembly 80 further comprises control panel 82 that has switches 84. Switches 84 may be activated to control heating and drying element 88, bulbs 86 that serve as illuminating means, and/or the motor assembly described above.

Figure 5:
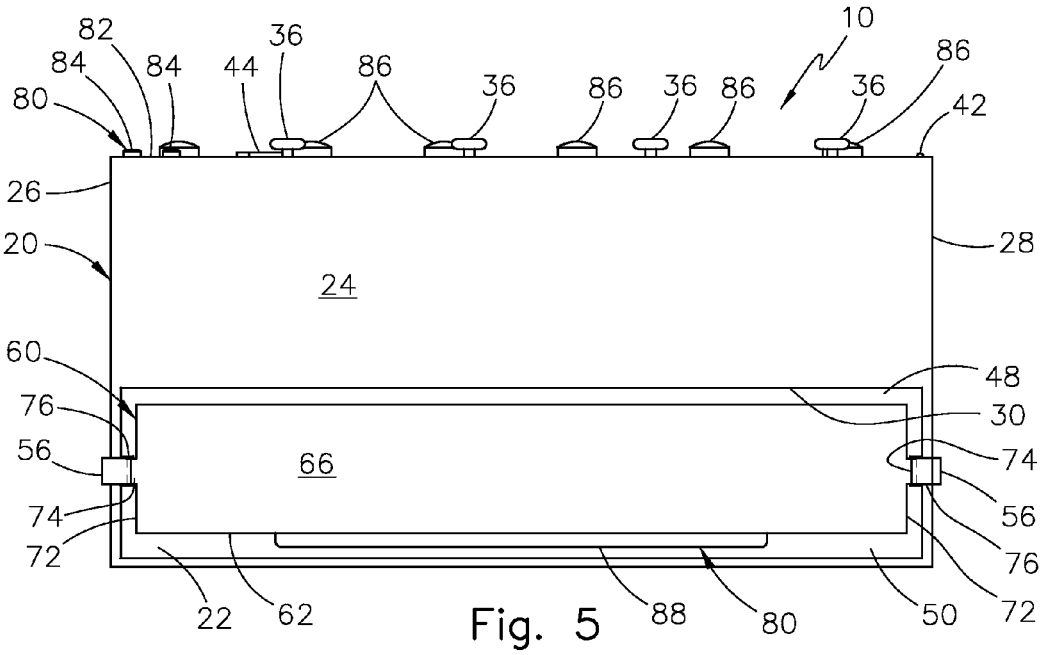
FIG. 5 is a bottom view of the instant invention.

As best seen in FIGS. 4 and 5, longitudinal tracks 76 respectively comprise stoppers 77, and longitudinal rails 74 respectively comprise stoppers 78. Stoppers 77 serve as a limit when drying assembly 60 is fully extracted from furniture assembly 20, whereby stoppers 77 block stoppers 78 and prevent further extraction.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. Clothes drying furniture, comprising:

A) a furniture assembly defining a housing, said furniture assembly having a first top wall, a first bottom wall, first and second lateral walls, an intermediate wall, a rear exterior wall, and a door, said first and second lateral walls each having longitudinal tracks mounted thereon, said first and second lateral walls each comprise a latching member;

B) a clothes drying assembly comprising a second top wall, a second bottom wall, third and fourth lateral walls, and a rear wall, said rear wall is made out of a netting material or mesh to allow heat produced by a heating and drying element to dry articles of clothing within said clothes drying assembly, said third and fourth lateral walls each having longitudinal rails mounted thereon, said longitudinal rails are journally mounted onto said longitudinal tracks, said clothes drying assembly positioned in between said intermediate wall and said rear exterior wall, said latching member keeps said clothes drying assembly housed within said furniture assembly and said clothes drying assembly extracts from said furniture assembly by gravity when said latching member is actuated; and C) an electrical assembly comprising said heating and drying element, said heating and drying element positioned in between said intermediate wall and said rear exterior wall, said electrical assembly further comprising power means.

2. The clothes drying furniture set forth in claim 1, further characterized in that said longitudinal tracks respectively comprise first stoppers.

3. The clothes drying furniture set forth in claim 2, further characterized in that said longitudinal rails respectively comprise second stoppers.

4. The clothes drying furniture set forth in claim 3, further characterized in that said first stoppers block said second stoppers thereby allowing said clothes drying assembly to protrude a first predetermined distance from said furniture assembly.

5. The clothes drying furniture set forth in claim 4, further characterized in that said rear exterior wall is a second predetermined distance from said rear wall.

6. The clothes drying furniture set forth in claim 5, further characterized in that said rear wall is a third predetermined distance from said intermediate wall.

7. The clothes drying furniture set forth in claim 6, further characterized in that said door has hinges, a door handle, and a mirror mounted thereon.

8. The clothes drying furniture set forth in claim 1, further characterized in that said clothes drying assembly further comprises at least one dividing wall positioned in between said third and fourth lateral walls.

9. The clothes drying furniture set forth in claim 1, further characterized in that said clothes drying assembly comprises at least one hook to hang at least one article of clothing therefrom.

10. The clothes drying furniture set forth in claim 1, further characterized in that said electrical assembly further comprises at least one control panel.

11. The clothes drying furniture set forth in claim 10, further characterized in that said at least one control panel comprises at least one switch.

12. The clothes drying furniture set forth in claim 11, further characterized in that said electrical assembly further comprises illuminating means.

13. The clothes drying furniture set forth in claim 1, further characterized in that said furniture assembly further comprises at least one internal sidewall positioned in between said first and second lateral walls.

14. The clothes drying furniture set forth in claim 1, further characterized in that said furniture assembly further comprises at least one drawer that rests upon said first bottom wall, said at least one drawer comprising a handle.

15. The clothes drying furniture set forth in claim 1, further characterized in that said furniture assembly further comprises at least one shelve positioned in between said intermediate wall and said door.

16. The clothes drying furniture set forth in claim 1, further characterized in that said furniture assembly further comprises a basket to support a scented pad.

17. Clothes drying furniture, comprising:

A) a furniture assembly defining a housing, said furniture assembly having a first top wall, a first bottom wall, first and second lateral walls, an intermediate wall, a rear exterior wall, and a door, said first and second lateral walls each having longitudinal tracks mounted thereon, said longitudinal tracks respectively comprise first stoppers, said first and second lateral walls each comprise a latching member;

B) a clothes drying assembly comprising a second top wall, a second bottom wall, third and fourth lateral walls, and a rear wall, said rear wall is made out of a netting material or mesh to allow heat produced by a heating and drying element to dry articles of clothing within said clothes drying assembly, said third and fourth lateral walls each having longitudinal rails mounted thereon, said longitudinal rails respectively comprise second stoppers, said longitudinal rails are journally mounted onto said longitudinal tracks, said clothes drying assembly positioned in between said intermediate wall and said rear exterior wall, said latching member keeps said clothes drying assembly housed within said furniture assembly and said clothes drying assembly extracts from said furniture assembly by gravity when said latching member is actuated; and C) an electrical assembly comprising said heating and drying element, said heating and drying element positioned in between said intermediate wall and said rear exterior wall, said electrical assembly further comprising power means and a motor assembly.

18. The clothes drying furniture set forth in claim 17, further characterized in that said first stoppers block said second stoppers thereby allowing said clothes drying assembly to protrude a first predetermined distance from said furniture assembly.

19. The clothes drying furniture set forth in claim 18, further characterized in that said clothes drying assembly further comprises at least one dividing wall positioned in between said third and fourth lateral walls, said clothes drying assembly further comprises at least one hook to hang at least one article of clothing therefrom, said furniture assembly further comprises at least one internal sidewall positioned in between said first and second lateral walls, said furniture assembly further comprises at least one drawer that rests upon said first bottom wall, said at least one drawer comprising a handle, said furniture assembly further comprises at least one shelve positioned in between said intermediate wall and said door, said furniture assembly further comprises a basket to support a scented pad, said rear exterior wall is a second predetermined distance from said rear wall, and said rear wall is a third predetermined distance from said intermediate wall.

* * * * *